US005129579A

United States Patent [19]

Conte

[11] Patent Number: 5,129,579

[45] Date of Patent: Jul. 14, 1992

[54] VACUUM ATTACHMENT FOR ELECTRONIC FLUX NOZZLE

[75] Inventor: Alfred S. Conte, Hollister, Calif.

[73] Assignee: Sun Microsystems, Inc., Mountain View, Del.

[21] Appl. No.: 603,286

[22] Filed: Oct. 25, 1990

[51] Int. Cl.[5] ..... B05B 17/04; B05B 1/08

[52] U.S. Cl. ..... 239/4; 239/104

[58] Field of Search ..... 239/290.1, 104, 396, 239/1, 4; 15/415.1, 422.1

[56] References Cited

U.S. PATENT DOCUMENTS

| | | | |
|---|---|---|---|
| 1,462,861 | 7/1923 | Jordon | 239/104 X |
| 2,407,751 | 9/1946 | Stewart | 15/415.1 X |
| 4,857,367 | 8/1989 | Thorn et al. | 239/104 X |

FOREIGN PATENT DOCUMENTS

| | | | |
|---|---|---|---|
| 584898 | 12/1977 | U.S.S.R. | 239/120 |

*Primary Examiner*—Andres Kashnikow
*Assistant Examiner*—Kevin P. Weldon
*Attorney, Agent, or Firm*—Blakely, Sokoloff, Taylor & Zafman

[57] ABSTRACT

A cylindrical body is provided over an ultrasonic flux nozzle. The cylindrical body contains a cavity inside generating a vacuum when the flux nozzle in in operation. Additionally, the portion of the top surface of the cylindrical body that is adjacent to the output of the flux nozzle has passageways for drawing off excess flux into the cavity. As a result, flux that exits the nozzle in an atomized vapor form is limited to a fine stream, thereby allowing the amount of flux to be deposited on a desired area to be precisely controlled.

13 Claims, 1 Drawing Sheet

VACUUM ATTACHMENT FOR ELECTRONIC FLUX NOZZLE

FIELD OF THE INVENTION

The present invention relates to the field of manufacturing tools for electronic devices, and more specifically, a vacuum attachment to be used in conjunction with an ultrasonic flux nozzle.

ART BACKGROUND

Most electronic devices are assembled by soldering their constituent components together. In the soldering process, a metal alloy is melted and used to join two adjacent metal surfaces together. The metallic surfaces which are to be joined are heated. The soldering material is then brought into contact with the heated surfaces. The alloy is chosen such that its melting point is fairly low. The solder is most often lead or tin based. The heated metallic surfaces causes the solder to become liquid and flow around the parts to be joined. When the solder cools and solidifies, a solid joint is thereby formed between the two elements. Because the joining medium is metallic, the soldering process result in a good electrical contact between the two elements which are joined.

In order to facilitate the soldering process, a material known as flux may be brought into contact with the solder in order to induce the melting of the solder. Flux is a rosin based material. It is used to clean the metallic surfaces and free them of oxides. This results in better thermal contact between the elements to be joined and enhances the melting of the solder.

In the past, solder was applied to the elements to be joined with a hypodermic needle means. During this process, a tremendous amount of excess, unused, flux was also deposited. The addition of flux to the soldering process has its disadvantages in that it can deteriorate the quality of the electrical contact between the elements which are joined. The excess flux must be removed via a cleaning process. This can involve the use of unwanted chemicals, such as freon.

For this reason, it is desirable that the minimum amount of flux necessary to be used during the soldering process, and that the flux be accurately deposited at the desired location. Devices are known in the prior art which use ultrasonic methods to provide a fine spray of flux. This fine spray can be applied to a given area which is to be soldered.

The ultrasonic devices typically consist of a relatively long, thin nozzle which is vibrated at a high frequency. Liquid flux enters the ultrasonic device and, as it passes through the nozzle, is broken into small droplets by the vibration of the nozzle. The small droplets exit the nozzle in the form of an atomized vapor spray. The ultrasonic devices reduce the amount of flux which must be used because the smaller elements of the flux can easily attach to the items which are to be soldered. These devices have the drawback, however, that they disperse the flux over a relatively large area and cannot be precisely aimed. As noted above, this may result in a poor electrical contact in the items which are to be joined, which could result in a deterioration of the operation of the overall assembly. Also, the need to clean the device is, for most cases, obviated.

SUMMARY OF THE INVENTION

The present invention overcomes the limitations of the prior art by providing a vacuum device which can be attached to an ultrasonic flux nozzle and which allows the amount of flux which is deposited on the desired area to be very precisely controlled. A cylindrical body is placed over the flux nozzle. The body contains a cavity inside which a vacuum may be generated. The portion of the top surface of the body that is adjacent to the output of the flux nozzle has passageways for drawing off excess flux into the cavity. When the ultrasonic flux nozzle in operation and when a vacuum is formed in the cavity, flux that exits the nozzle in an atomized vapor form is limited to a fine stream. Any flux that may tend to spread outward from the stream is drawn through the passageways and into the cavity by the vacuum pressure.

DETAILED DESCRIPTION OF THE INVENTION

The following specification presents a description of a vacuum attachment for an ultrasonic flux nozzle. The vacuum attachment may be used to control the precision of the output of the nozzle. In the following specification, many details such as particular component arrangements and specific dimensions are described in order to provide a more thorough understanding of the present invention. It will be apparent to those skilled in the art, however, that the invention may be practiced without these specific details. In other instances, well-known components and functions are not described so as not to obscure the present invention unnecessarily. Moreover, the present invention is described in conjunction with an ultrasonic flux nozzle because the present invention is designed to be used with such a device. It is to be understood, however, that the ultrasonic flux nozzle is not an element of the present invention. The present invention consists only of the vacuum attachment as described and claimed.

Figure 1:
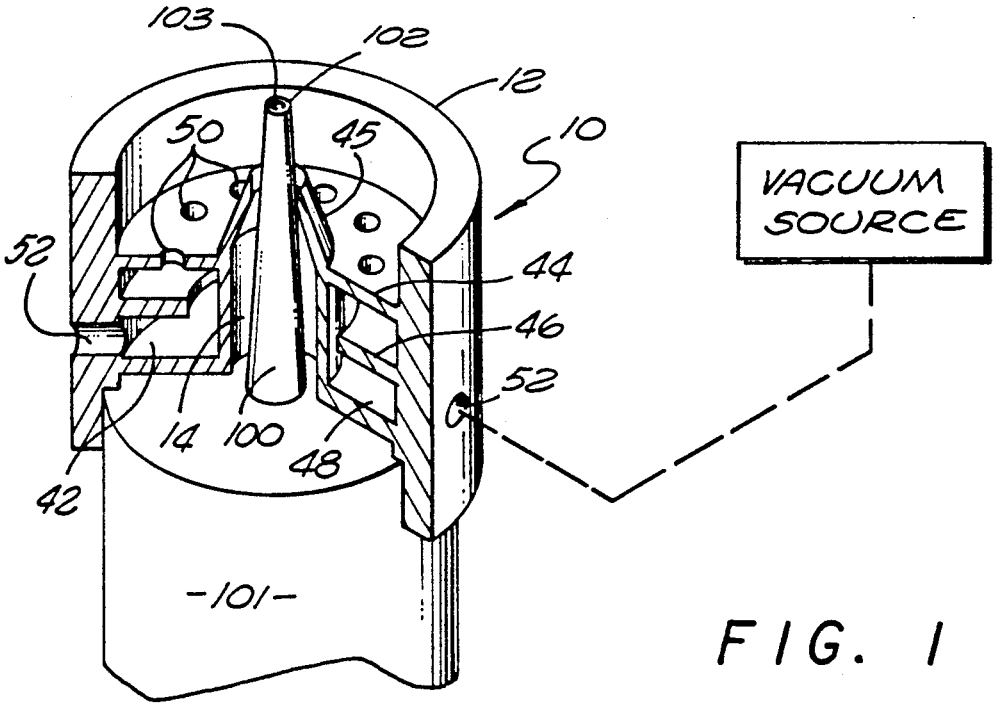
FIG. 1 is a perspective view of the present invention showing the vacuum attachment coupled to an ultrasonic flux nozzle.

Referring first to FIG. 1, a perspective view of the present invention is shown. In FIG. 1, the vacuum attachement is shown partially cut away so as to reveal the interior details of the device. The vacuum attachment 10 is placed over the nozzle 100 of the ultrasonic flux device 101. With most ultrasonic flux devices, the nozzle 100 is generally shaped in the form of an extended cylinder. With the ultrasonic flux device, flux enters the bottom of the nozzle 100 in liquid form. Pressure causes the flux to travel upward through the nozzle towards its end 102. A suitable mechanism (not shown in FIG. 1) is provided to vibrate the nozzle 100. This vibration takes place at a very high frequency. The vibration causes the liquid flux to break up into tiny droplets which exists the nozzle 100. The flux exits in an atomized vapor spray form through the opening 103 in the tip 102. The ultrasonic flux nozzle atomizes particles to the 20 to 50 micron range. By shaping the tip 102 and opening 103 in certain ways, the flux can be made to disperse in a given pattern. It has been found that the exact shape and extent of such a pattern cannot be adequately controlled in a sufficient manner. Without the vacuum attachment of the present invention, therefore, excess flux may travel in any random direction, which lends to unwanted flux deposition on the elements that are to be soldered together.

As noted above, the vacuum device 10 is placed over the nozzle 100. In the preferred embodiment, the vacuum device 10 is substantially cylindrical in shape and is made up of an elongated body 12. A central hole 14 is present to provide access for the nozzle 100. A number of openings 50 are formed into the top surface of the body 12. These openings allow access to a cavity 42 formed within the body. A vacuum source (not shown) is coupled to the body 12 through the exhaust holes 52.

Figure 2:
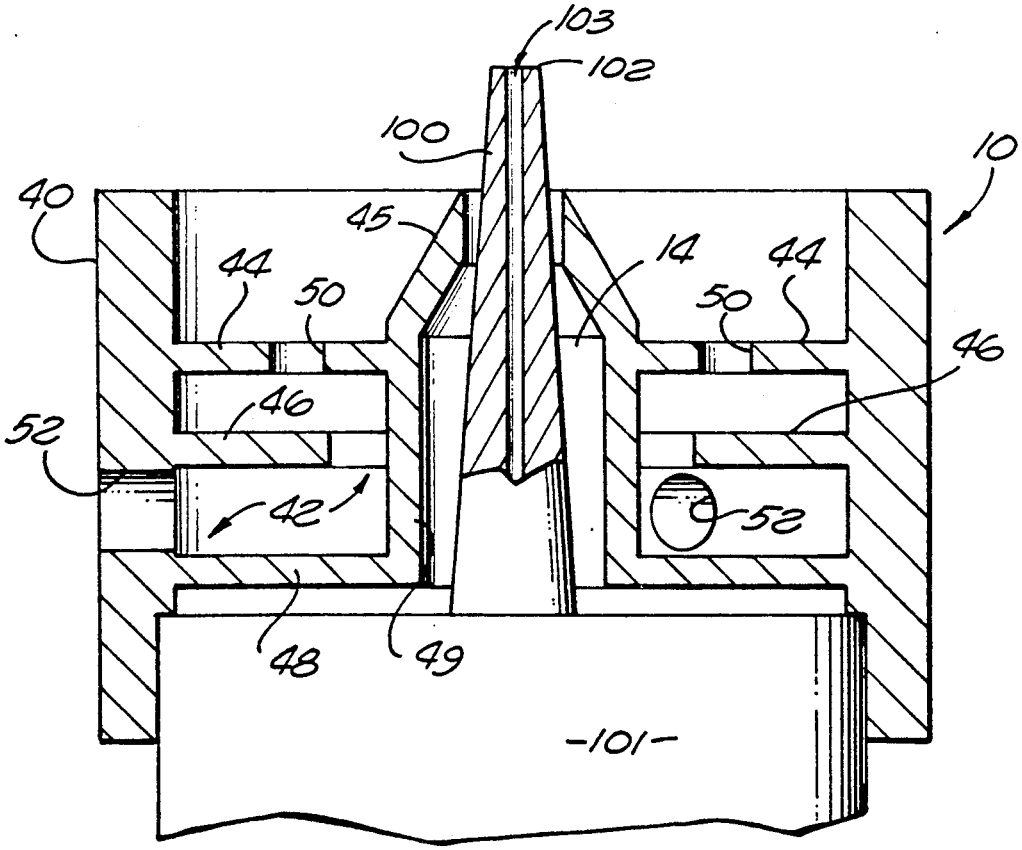
FIG. 2 is a cross-sectional view of the preferred embodiment of the present invention.

Referring next to FIG. 2, a cross-sectional view of the preferred embodiment of the vacuum attachment means is illustrated. In this view, the vacuum attachment 10 is shown mounted on the ultrasonic flux device 101. The nozzle 100 of the ultrasonic flux device extends upwards through the central hole 14 in the vacuum attachment 10. In the preferred embodiment, a cylindrical outer wall 40 couples with the ultrasonic flux device 101 as shown. An upper member 44 and lower member 48 protrude radially inward from the outer wall 40 towards the nozzle 102. These upper and lower members combine with inner cylindrical wall 49 to define a cavity 42 within the vacuum device.

In FIG. 2, the upper member 44 and lower member 48 appear to be straight members. When viewed from above, these elements are actually shaped as disks because the entire vacuum unit is cylindrical in shape in the preferred embodiment. Although the body 12 of the vacuum attachment 10 in the preferred embodiment is cylindrical in shape, it will be appreciated by those skilled in the art that the present invention is not limited to such a shape. Other arrangements may be used, so long as the body 12 surrounds the nozzle 102.

An inner support member 45 extends upward from the top member 44 and angles inward toward the nozzle 102. This support member 45 is used as an alignment means to position the vacuum unit 10 on the ultrasonic flux device 101. As with the outer wall 40 and inner wall 49, although there appear to be two support walls 45 in FIG. 2, the entire device is circular so that a single support wall 45 actually travels the entire circumference around the nozzle 102. Other positioning means may be used with equivalent results. For example a rubber grommet may be placed in the central hole 14 to align the vacuum attachment on the nozzle.

At least one exhaust hole 52 is formed within the outer wall 40. The exhaust hole 52 provides a passageway between the interior cavity 42 and the outside of the vacuum coupling 10. A vacuum source (not shown in FIG. 2 but illustrated schematically in FIG. 1) is attached to the exhaust hole 52. This vacuum source causes a low pressure vacuum to be formed within the cavity 42. FIG. 2 illustrates two exhaust holes 52. In the preferred embodiment there are actually three exhaust holes spaced at equidistant intervals. The vacuum source is coupled to each of these exhaust holes. This arrangement provides for balanced pressure levels within the cavity 42. It will be appreciated by those skilled in the art that a different number of exhaust holes may be provided with equivalent results. The flux is drawn through the exhaust holes. A filter means is provided outside of the vacuum unit (not shown in FIG. 2) to filter the flux vapor out of the airflow.

Formed within the top member 44 are a plurality of openings 50. These openings 50 are used to draw off any excess flux which has been transformed into the aerosol state as described above. The operation of these openings 50 will be described more fully below.

Coupled to the inside of the outer wall 40 and within the cavity 42 is a circular shelf 46. The shelf 46 is used to balance the air pressure at all points within the cavity 42. Shelf 46 accomplishes this task by preventing laminar fluid flow between the exhaust ports 52 and the nearest opening 50. In this manner, the vacuum pressure is substantially balanced at all of the openings 50. This arrangement enhances the overall operation of the vacuum attachment 10.

The operation of the vacuum attachment is quite straightforward. A user simply places the device on the ultrasonic flux device 101. The ultrasonic flux device 101 is turned on. As described above, this results in a fine atomized vapor spray of flux being emitted form the opening 103 at the end 102 of the nozzle 100. It is most often desirable that this flux move in a straight line axially outward away form the nozzle 100. Excess flux may also move radially outward from the end of the nozzle, as noted above. In that case, the excess flux will travel over the openings 50 in the vacuum attachment. The vacuum in the cavity 42 will cause a low pressure region to be formed above the openings 50. The flux will be drawn towards this low pressure region and into the cavity 42. Thus, with the present device, excess flux is not allowed to be deposited on the elements of the electronic units which are to be soldered together. This allows the flux to be accurately positioned and allows the use to carefully control the amount of flux which is used.

The foregoing has described a vacuum attachment for an ultrasonic flux nozzle. This description has been made with reference to specific exemplary embodiments thereof. It will be appreciated by those skilled in the art that various departures from these embodiments can be made without departing from the overall spirit and scope of the present invention. Some of these changes have been described. Others are possible. The full scope of the present invention is limited only by the following claims.

What is claimed is:

1. An ultrasonic flux device, said device comprising: flux source means for providing flux;

a nozzle coupled to said flux source means for projecting flux;

a vacuum attachment having a vacuum cavity located therein, said vacuum attachment being placed circumferentially around said nozzle, said vacuum attachment having at least one opening located behind said nozzle, said openings allowing access to said vacuum cavity;

a vacuum source coupled to said vacuum cavity for creating a vacuum in said vacuum cavity; such that excess flux passing over said openings is drawn into said vacuum cavity.

2. The device of claim 1 wherein said vacuum attachment further comprises alignment means for positioning said vacuum attachment on said nozzle.

3. The device of claim 1, wherein said vacuum source is coupled to said vacuum attachment through at least one hole in an outer wall of said vacuum attachment.

4. The device of claim 1 wherein said openings are disposed in a circular pattern circumferentially around said nozzle.

5. The device of claim 1 wherein said vacuum attachment further includes a means for equalizing pressure inside said vacuum cavity.

6. A vacuum attachment for an ultrasonic flux device, said device having a nozzle with an opening which emits flux droplets located at one end thereof, said vacuum attachment comprising:

a first cylindrical wall extending circumferentially around said nozzle;

an upper member extending radially outward from said first wall at top edge thereof, said upper member located behind the opening of said nozzle, said upper member having at least one opening disposed therethrough;

a lower member extending radially outward from said first wall at a bottom edge thereof;

a second cylindrical wall extending circumferentially around said nozzle and attached to outer edges of said lower and upper members, so as to define a vacuum cavity, said second cylindrical wall having at least one exhaust hole formed therethrough;

a vacuum source coupled to said at least one exhaust hole; such that excess flux droplets that exit said nozzle in directions that pass over said openings are drawn through said openings and into said vacuum cavity.

7. The device of claim 6 further comprising a circular shelf extending radially inward from an inner surface of said outer wall.

8. The device of claim 6 further comprising a support wall coupled to said inner wall for positioning said vacuum attachment on said nozzle.

9. The device of claim 6 wherein said openings in said upper member are arranged in a substantially circular pattern, centered on said nozzle.

10. The device of claim 6 wherein said second cylindrical wall has three exhaust holes formed therein, said exhaust holes being spaced at equidistant intervals around a circumference of said second cylindrical wall.

11. The device claim 6 wherein said vacuum source further comprises a filter means to remove the excess flux drawn into said openings.

12. A method of precisely applying soldering flux, said method comprising the steps of:

providing a flux stream passing through the opening of a nozzle;

providing a vacuum attachment attached to said nozzle, said vacuum attachment having at least one opening located behind the opening of said nozzle;

vibrating said nozzle and said vacuum attachment such that the flux stream exits said nozzle as droplets;

creating a vacuum within said vacuum attachment such that flux droplets which exit said nozzle in directions which pass over said openings are drawn into said openings of the vacuum attachment.

13. The method of claim 12 wherein the step of vibrating said nozzle and said vacuum attachment further comprises vibrations in the ultrasonic frequency.

* * * * *